United States Patent [19]

Lee et al.

[11] Patent Number: 5,018,358

[45] Date of Patent: May 28, 1991

[54] CRYOGEN DELIVERY APPARATUS

[75] Inventors: Ron C. Lee, Bridgewater; Mark J. Kirschner, Morristown, both of N.J.

[73] Assignee: The BOC Group, Inc., Murray Hill, N.J.

[21] Appl. No.: 496,397

[22] Filed: Mar. 20, 1990

[51] Int. Cl.[5] ..... F17C 7/04

[52] U.S. Cl. ..... 62/48.1; 62/49.2; 62/50.1; 62/50.5

[58] Field of Search ..... 62/48.1, 49.2, 50.1, 62/50.5

[56] References Cited

U.S. PATENT DOCUMENTS

| | | | |
|---|---|---|---|
| 4,592,205 | 6/1986 | Brodbeck et al. | 62/50.1 |
| 4,607,489 | 8/1986 | Krongold | 62/49.2 |
| 4,873,832 | 10/1989 | Porter | 62/49.2 |

*Primary Examiner*—Ronald C. Capossela
*Attorney, Agent, or Firm*—Robert I. Pearlman; David M. Rosenblum

[57] ABSTRACT

The present invention relates to an apparatus for delivery of pure gaseous and liquid forms of cryogen. The apparatus includes a pressure vessel for receiving a liquid form of the cryogen. A liquid-vapor interface is maintained within the pressure vessel by a liquid level detector and a cut-off valve connected to the level detector to vent the gaseous form of the cryogen to the atmosphere when the liquid form falls below a predetermined level. A heated overflow tube projects into the pressure vessel and is positioned at the predetermined level of the liquid. When the liquid rises above the predetermined level, it flows into the overflow tube and is heated to vapor to add to the gaseous form of the cryogen within the pressure vessel. An outlet conduit is provided for delivering the gas and liquid forms of the cryogen from the pressure vessel. The conduit has a moveable end section located within the pressure vessel. When the movable end section is moved above the level of a liquid-vapor interface, the gas form of the material is delivered from the conduit; and when the moveable end section is positioned below the liquid-vapor interface, a pure liquid form of the cryogen is delivered from the pressure vessel. Movement of the moveable end section of the conduit is preferably controlled by a solenoid connected to a timing circuit.

7 Claims, 1 Drawing Sheet

CRYOGEN DELIVERY APPARATUS

BACKGROUND OF THE INVENTION

The present invention relates to an apparatus for delivering a cryogen in pure liquid and gaseous forms. More particularly, the present invention provides an apparatus capable of receiving a cryogen, such as nitrogen or carbon dioxide, of arbitrary quality and repeatedly delivering measured amounts of a pure liquid form of the cryogen and/or a pure gaseous form of the cryogen.

The gaseous and liquid forms of nitrogen are utilized in the blow molding of plastic articles. In blow molding, a cylinder of semi-molten plastic, called a parison, is extruded so that it descends by gravity into position between a pair of opposed mold sections. Gaseous nitrogen is released into the parison through a blowing pin until the plastic fits the mold. The gaseous nitrogen is produced by allowing liquid nitrogen from a liquid supply tank to absorb heat in a pipe line leading to the blowing pin. During the blowing cycle, the injection system gradually cools until liquid nitrogen enters the mold in a fine atomized spray to cool the molded article. After the mold is cooled, the mold sections are spread apart for removal of the molded plastic article.

In other cryogenic applications, it is necessary to only deliver measured amounts of a liquid cryogen. For instance, measured amounts of liquid nitrogen are delivered to food containers for producing an inerting atmosphere. In another application, measured amounts of liquid nitrogen are delivered to food containers so that when sealed, the interior of the container is pressurized as the liquid nitrogen boils off within the container. Such pressurization enables the container to maintain its structural integrity.

In all of the above-described applications, which it should be pointed out are described in relation to nitrogen for exemplary purposes only, it is necessary to repeatedly deliver exact amounts of pure liquid and/or gaseous forms of nitrogen. In case of delivery of measured amounts of a liquid cryogen, such as liquid nitrogen in the food process industry, the liquid cryogen is metered by valves, which in the cryogenic environment tend to wear out rather rapidly. Moreover, in the injection blow molding art, the temperature of the liquid nitrogen in the storage tank varies after each filling of storage tank and therefore, the quality of liquid nitrogen that is delivered is also variable.

The present invention solves these problems by providing an apparatus that can repeatedly and intermittently deliver measured amounts of a cryogen in either a liquid and/or a gaseous form, and which does not utilize conventional valves for the metering of the liquid form of the cryogen.

SUMMARY OF THE INVENTION

The present invention relates to an apparatus for selectively delivering a cryogen in pure liquid and gaseous forms. The apparatus comprises a pressure vessel having an inlet for receiving the cryogen within the pressure vessel. Means are provided for maintaining the cryogen within the pressure vessel so that a liquid-vapor interface is produced within the pressure vessel. Conduit means, which extend into the pressure vessel, is provided with a moveable end section adapted for movement above the liquid-vapor interface to deliver the pure gaseous form of the cryogen from the pressure vessel and below the liquid-vapor interface for delivering the pure liquid form of the cryogen from the pressure vessel. Actuation means are connected to the moveable end section of the conduit means for selectively moving the conduit means above and below the liquid-vapor interface for the duration of preset time intervals so that gaseous and liquid forms of the cryogen are selectively delivered from the pressure vessel in quantities proportional to the preset time intervals.

BRIEF DESCRIPTION OF THE DRAWINGS

While the specification concludes with claims particularly pointing out the subject matter that Applicants regard as their invention, it is believed that the invention will be better understood from the following description taken in conjunction with the accompanying drawings in which:

DETAILED DESCRIPTION

Figures 1, 2, 3:
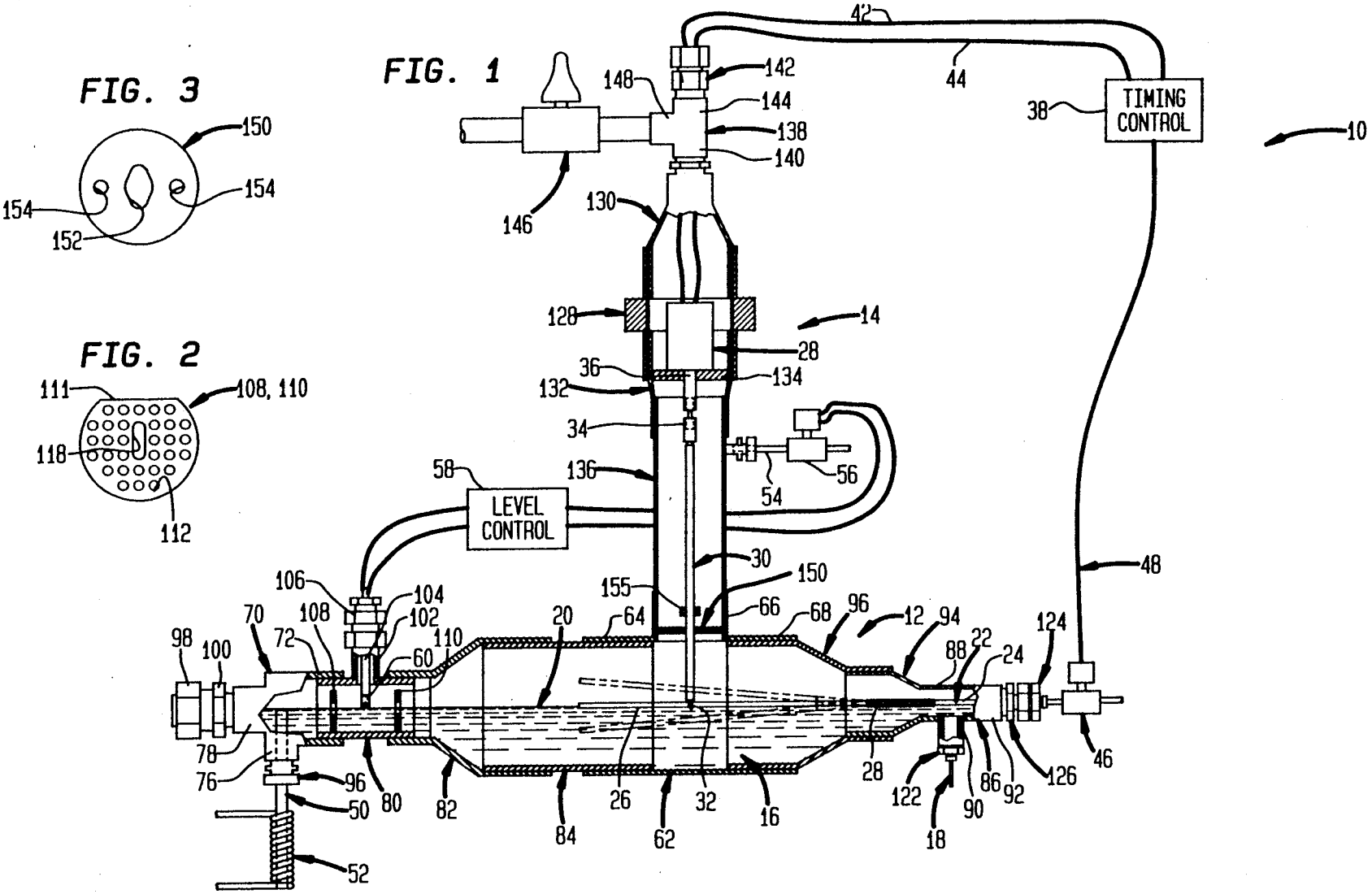
FIG. 1 is an elevational view of a cryogen delivery apparatus in accordance with the present invention with portions broken away.
FIG. 2 is a plan view of a baffle plate used in the apparatus shown in FIG. 1.
FIG. 3 is a plan view of a guide plate used in the apparatus shown in FIG. 1.

With reference to FIG. 1, a preferred embodiment of a cryogen delivery apparatus 10 is illustrated. Although not illustrated, apparatus 10, when in use, is preferably insulated with vacuum jacketing or expanded foam.

Apparatus 10 is a pressure vessel having a cryogen receiving/ delivering portion 12 connected to a tower portion 14 in a "T"-like configuration. A cryogen 16 is received within cryogen receiving/ delivery portion 12 through an inlet conduit 18. Although, as indicated above, apparatus 10 is used in an insulated environment, ambient heat, albeit at a low heat transfer rate, causes cryogen 16 to boil off into a liquid and a gaseous phase separated by a liquid-gas interface designated by reference numeral 20. Moreover, the quality of cryogen 16 as received from inlet conduit 18 is arbitrary, and thus, cryogen 16 tends to separate into the liquid and gaseous phases within cryogen receiving/ delivery portion 12. As will be discussed, liquid-vapor interface 20 is preferably maintained at the level of the central axis of cryogen receiving/delivery portion 12.

The cryogen is delivered from apparatus 10 through an outlet conduit 22 having an outlet section 24 and a moveable end section 26, movable above and below liquid-gas interface 20. Movable end section 26 is connected to outlet section 24 by a flexible central section 28 preferably formed by an extruded steel bellows. In the illustrated preferred embodiment, the extruded steel bellows comprises a 0.64 cm. stainless steel flexible tubing manufactured by CAJON Co. of 9760 Shepard Road, Macedonia, Ohio 44056.

When moveable end section 26 is raised above liquid-gas interface 20 into the gaseous phase of cryogen 16, a pure gaseous form of cryogen 16 is delivered from outlet conduit 22; and when moveable end section 26 is lowered below liquid-gas interface 20 into the liquid phase of cryogen 16, a pure liquid form of cryogen 16 is delivered from outlet conduit 22. As may be appreciated, the time intervals in which moveable end section 26 is above and below liquid-gas interface 20 will determine the amount of pure liquid and gaseous forms of cryogen 16 that are delivered from cryogen delivery apparatus 10.

Moveable end section 26 is raised and lowered by a solenoid 28 acting through a rod 30 connected, at one end, by a wire loop 32 to moveable end section 26 and at the other end by a rod end 34 to an actuating arm 36 of solenoid 28. It should be mentioned that solenoid 28 is preferably an open frame AC solenoid manufactured by LUCAS LEDEX Inc. of 801 Scholz Drive, Vandalia, Ohio 45377. Rod end 34, which may be obtained from a variety of manufacturers, is a particularly preferred component of apparatus 10 to allow some degree of imprecision in its manufacture.

Means, preferably in the form of a timing control circuit 38, is connected to solenoid 28 by lead-in wires 42 and 44. Timing control circuit 38 is one of many well known circuits that permit time intervals to be preset and are capable of activating solenoid 28, by electrical impulse, to lower or raise moveable end section 26 for the duration of such preset time intervals. As may be appreciated, if for instance, timing control circuit 38 is set to lower or raise moveable end section 26 in equal time intervals, equal amounts of the selected form of cryogen 16 will be repeatedly delivered from apparatus 10.

Although not illustrated, inlet line 18 could be provided with a throttle valve. The throttle valve could be preset to control the flow rate of cryogen 16 in inlet line 18. Such inlet line throttling would result in an adjustment of the mass flow rates of the gaseous and liquid forms of cryogen 16 flowing through outlet conduit 22 in equal amounts. Additionally, outlet conduit 22, within outlet section 24 thereof, could also be provided with a throttling valve. Such a throttle valve would simultaneously adjust the mass flow rates of the gaseous and liquid forms of cryogen flowing through outlet conduit 22 in a proportion approximately equal to the ratio of the square root of their mass densities. The simultaneous adjustment of the inlet line throttling valve and the outlet conduit throttling valve would allow an adjustment in the flow rates of either the liquid or gaseous forms of cryogen 16 within the range discussed above.

A solenoid operated cut-off valve 46, also connected to timing control circuit 38 by an electrical connection 48, is preferably provided in outlet section 24 to allow the gaseous flow of cryogen to be cut off in those applications of apparatus 10 in which only measured amounts of the liquid form of cryogen 16 is to be delivered or, to limit the amount of the gas form of cryogen 16 that is to be delivered even if both the gas and liquid forms of cryogen 16 are to be utilized in a particular process. When timing control circuit 38 activates solenoid 28 to raise moveable end section 26 into the gaseous phase of cryogen 16, timing control circuit also closes cut-off valve 46. In this regard, in an application in which only the liquid form of cryogen 16 is to be delivered, timing control circuit 38 closes cut-off valve 46 with a slight time delay to purge the liquid form of cryogen 16 from outlet conduit 22. In such application, cut-off valve 46 is being used to limit the loss of cryogen 16. In an application in which a measured amount of the gas form of cryogen 16 is to be delivered, timing control circuit 38 can be set with a time delay to close cut-off valve 46 in accordance with the amount of the gas form of cryogen 16 that is to be delivered. In either of such applications, cut-off valve 46 is only being utilized to cut-off the flow of the gas form of cryogen 16; and may be inexpensively fabricated in accordance with less stringent positive cut-off requirements for a valve that is to cut off the gas flow of a cryogen over one that is required to cut off the liquid flow of a cryogen. Although not illustrated, a single-pole, single-throw switch could be provided in electrical connection 48 to disable the operating mode of apparatus 10 in which only the liquid form of cryogen 16 is to be delivered.

Liquid-gas interface 20 is maintained at the level of the central axis of cryogen receiving/delivery portion 12 by an overflow tube 50 which is open at its top end) within cryogen receiving/delivery portion 12) and closed at its lower end) below cryogen receiving/delivery portion 12). A tube 52, in which room temperature dry air or nitrogen circulates, is coiled about the lower end of overflow tube 50. As the level of the liquid phase of cryogen 16 rises above the open top end of overflow tube 50, it flows into overflow tube 50 and is heated by tube 52. After heating, the liquid form of the cryogen vaporizes to increase the amount of the gaseous form of the cryogen contained within cryogen receiving/delivery portion 12. As may be appreciated, the lower end of overflow tube 50 could be provided with an electrical heater or an arrangement of fins to function in place of tube 52 for heating the lower end of overflow tube 50.

The level of the gas phase of cryogen 16 is maintained by venting the gaseous form of cryogen 16 through a vent line 54 connected to tower portion 14. The venting is controlled by a solenoid operated cut-off valve 56 in vent line 54 which is activated to open by a level control circuit 58, preferably a liquid level control manufactured by KAY-RAY/SENSALL Inc. of 523 Townline Road, Suite 4, Hauppauge, N.Y. 11788. When the level of the liquid phase of cryogen 16 falls below the central axis of cryogen receiving/delivery portion 12, a liquid level sensor 60, preferably an ultrasonic level sensor, also manufactured by KAY-RAY/SENSALL Inc, causes level control circuit 58 to activate cut-off valve 56 to open and vent the excess gaseous form of cryogen 16. For system stability purposes, there should be a slight overlap between the height of the top end of overflow tube 50 above the central axis of cryogen receiving/delivery portion 12 and the level of liquid below the central axis of cryogen receiving/delivery portion 12, at which cut-off value 56 is activated. As mentioned above, cryogen 16, when in inlet line 18, may be of arbitrary quality, but preferably no less than 50%. As the quality of cryogen 16 falls, more vapor will be vented through vent line 54 to maintain the level of cryogen 16. As the quality of cryogen 16 rises, more liquid will be vaporized in overflow tube 50 to maintain the level of cryogen 16.

Cryogen receiving/delivery portion 12 and tower portion 14 are preferably fabricated from conventional copper plumbing fittings. The size of the fittings and therefore, the volume of portions 12 and 14 may be selected in accordance with the cryogen/delivery requirements for the intended application of apparatus 10.

As illustrated, cryogen receiving/delivery portion 12 includes a central "T" fitting 62 having legs 64, 66 and 68. At the illustrated left side of portion 12, a reducing "T" fitting 70, having legs 72, 76, and 78 is connected, at leg 72 and by a pipe 80, to a reduction fitting 82 which is in turn connected by a pipe 84 to leg 64 of "T" fitting 62. At the illustrated right side of portion 12, a reducing "T" fitting 86 having legs 90 and 92, is connected, at leg to a reduction fitting 94 which in in turn connected by a reduction fitting 96 to leg 68 of "T" fitting 62.

Overflow tube 50 is connected to leg 76 of reducing "T" fitting 70 by a pressure coupling 96. An end plug 98 is threadably secured to a threaded coupling 100 which is connected to leg 78 of reducing "T" fitting 70.

A pipe 102 is connected, at right angles, to pipe 80 for mounting level sensor 60 within cryogen receiving-/delivery portion 12. Level sensor 60 is threaded onto the lower end of a tube 104, which is connected to the top end of pipe 102 by a compression fitting 106.

Referring now to FIG. 2, baffle plates 108 and 110 are connected within pipe 80 on opposite sides of level sensor 60 to prevent unnecessary venting of the gaseous form of cryogen 16 from vent line 54 by preventing splashes of the liquid form of cryogen 16 from producing an erroneous, low height indication of gas-vapor interface 20. Such splashes may be produced by the rapid expansion of liquid cryogen 16 within overflow tube 50 or by wave motion of the liquid cryogen caused by the raising and lowering of moveable end section 26 of outlet conduit 22. In this regard, each of the baffle plates 108 and 110 is of disc-like configuration with a top section removed to form a top edge 111 spaced below the inside of cryogen receiving/delivery portion 12 for the free passage of the gaseous form of cryogen 16; and each has a plurality of apertures 112 to permit passage of the liquid form of cryogen 16 at a reduced flow rate. Thus, baffle plates 108 and 110 act as barriers; with baffle plate 108 acting as a barrier to splashes from airflow tube 50 and baffle plate 110 acting as a barrier to splashes from the raising and lowering of moveable end section 26. Both Baffle plates 108 and 110 are provided with central, elongated or oval apertures 118 for purposes that will be discussed hereinafter.

Inlet conduit 18 is connected to leg 90 of reducing "T" fitting 86 by a pressure coupling 122. Outlet section 24 of outlet conduit 22 is connected to pressure coupling 124 which is in turn connected by a pressure coupling 126 to leg 92 of reducing "T" fitting 86. Pressure coupling 124 may be removed to remove outlet conduit 22 from cryogen receiving/ delivery portion 12. Upon replacement of outlet conduit 22, end plug 98 is removed and a rod, not illustrated, may be extended through apertures 118 of baffle plates 108 and 110 to help in manipulating moveable end section 24 to extend into wire loop 32 of rod 30.

Tower portion 14 includes a pipe union 128 which joins a pair of upper and lower reduction fittings 130 and 132. Lower reduction fitting 130 is provided with a mounting plate 134 for mounting solenoid 28 and is connected to leg 66 of "T" fitting 62 by a pipe 136. Preferably pipe 136 is sized so that solenoid 28 is approximately 15.24 cm. above liquid-gas interface 20 to prevent freeze-up of solenoid 28. A "T" fitting 138 is connected at a leg 140 thereof to upper reduction fitting 130; and a wire lead in 142, connected to a leg 144 of "T" fitting 138, is provided for entry of wires into tower portion 14. A pressure relief valve 146, connected to a leg 148 of "T" fitting 138, is provided to prevent over pressures from destroying either tower portion 14 or cryogen receiving/delivery portion 12.

With reference to FIG. 3 are annular guide plate 150 is provided within the lower end of pipe 136 to serve as a guide for rod 30. To this end, guide plate 150 has a central aperture 152 through which rod 30 extends, and a pair of outlying apertures 154 for passage of the gaseous form of cryogen 16 into tower portion 14. Additionally, a collar 155 may be connected to rod 30 to limit the downward movement of moveable end section 26 of outlet conduit 22 by contacting guide plate 150.

Although preferred embodiments have been shown and described in detail, it will be readily understood and appreciated by those skilled in the art that numerous omissions, changes, and additions may be made without departing from the spirit and scope of the invention.

We claim:

1. An apparatus for selectively delivering a cryogen in pure liquid and gaseous forms, said apparatus comprising:

a pressure vessel having an inlet for receiving the cryogen within the pressure vessel;

means for maintaining the cryogen within the pressure vessel so that a liquid-vapor interface is produced within the pressure vessel;

conduit means extending into the pressure vessel and having a moveable section adapted for movement above and below the liquid-vapor interface for delivering the pure gaseous and liquid forms of the cryogen from the pressure vessel; and actuation means connected to the moveable section of the conduit means for selectively moving the moveable section of the conduit means above and below the liquid-vapor interface for the duration of preset time intervals so that the pure gaseous and liquid forms of the cryogen are selectively delivered from the pressure vessel in quantities proportional to the preset time intervals.

2. The apparatus of claim 1, wherein:

the conduit means comprises, a pipe having an outlet section extending into the pressure vessel, a moveable end section located within the pressure vessel to form the moveable section of the conduit means, and a flexible central section connecting the moveable end section to the outlet section; and the actuation means is connected to the moveable end section of the pipe.

3. The apparatus of claim 2, wherein the flexible central section comprises an extruded steel bellows.

4. The apparatus of claim 2, wherein the actuation means comprises:

a solenoid having an actuating arm;

rod means for connecting the actuating arm to the moveable end section of the pipe; and timing control means connected to the solenoid for activating the solenoid to raise and lower the moveable end section of the pipe above and below the liquid-vapor interface for the duration of the time intervals.

5. The apparatus of claim 4, wherein the pressure vessel comprises:

a horizontal cryogen receiving/delivery portion within which the liquid-vapor interface is maintained and the pipe extends; and a vertical tower portion connected to the cryogen receiving/delivery portion in a "T"-like configuration and housing the solenoid at a preselected height above the liquid form of the cryogen sufficient to prevent freeze-up of the solenoid.

6. The apparatus of claim 1, further comprising an inline cut-off valve connected to the conduit means and controlled by the actuation means to cut off the delivery of the gaseous form of the cryogen from the conduit means when the moveable end section is above the liquid-vapor interface.

7. The apparatus of claim 1, wherein the liquid-vapor interface maintaining means comprises:

a vent line connected to the pressure vessel and having an automatically actuated in line cut-off valve;

a level detector, located within the pressure vessel to sense the height of the liquid within the pressure vessel;

controlling means connected to the level detector and the cut-off valve for automatically opening the cut-off valve when the level of the liquid form of the cryogen falls below a predetermined height;

an overflow tube projecting into the pressure vessel so that one end thereof is essentially at the level of the predetermined height; and heating means connected to the other ends of the overflow tube and outside of the pressure vessel such that when the level of the liquid form of the cryogen is above the predetermined level, it flows into the overflow tube and is heated by the heating means and thereby vaporized to add to the gaseous form of the cryogen within in the pressure vessel.

* * * * *